United States Patent [19]

Benton

[11] Patent Number: 4,645,470

[45] Date of Patent: Feb. 24, 1987

[54] DOLL HAVING CONCEALED POCKET IN THE LOCATION OF AN EAR

[75] Inventor: Duane C. Benton, Westwood Hills, Kans.

[73] Assignee: The Trusty Doll Company, Kansas City, Mo.

[21] Appl. No.: 710,386

[22] Filed: Mar. 11, 1985

[51] Int. Cl.[4] ..... A63H 3/00

[52] U.S. Cl. ..... 446/73; 434/236; 434/260; D21/168

[58] Field of Search ..... 446/71, 72, 73, 74; 150/106; 434/236, 260; 224/153; D3/32, 45, 46, 48, 66; D6/597, 598, 599; D21/168; 5/432, 462

[56] References Cited

U.S. PATENT DOCUMENTS

| | | | |
|---|---|---|---|
| D. 123,840 | 12/1940 | Morris | D3/48 |
| D. 171,536 | 2/1954 | Flanagin | D6/598 |
| D. 232,747 | 9/1974 | Sharp | D21/168 |
| D. 260,698 | 9/1981 | Fitzgerald et al. | D3/32 |
| D. 280,534 | 9/1985 | Cassaro | D21/168 |
| 1,756,048 | 4/1930 | Williams | 446/74 X |
| 2,078,809 | 4/1937 | Richman | 446/74 |
| 2,591,379 | 4/1952 | Schradermeier | 150/106 X |
| 3,082,437 | 3/1963 | Upthagrove | 446/72 X |
| 4,096,978 | 6/1978 | Noice | D3/32 X |

FOREIGN PATENT DOCUMENTS

| | | | |
|---|---|---|---|
| 634309 | 11/1927 | France | 446/73 |

*Primary Examiner*—F. Barry Shay

*Attorney, Agent, or Firm*—Schmidt, Johnson, Hovey & Williams

[57] ABSTRACT

A doll, preferably of fabric material, and generally polygonal in configuration whereby to present a body having a front, a back, a top, a bottom and opposed sides, there being hair on the top of the body and a face on the front of the body. The body is provided with a receptacle in the form of a pocket carried by the body and accessible to a user of the doll, the pocket being located on the body in the position of an ear and simulating an ear of the doll whereby the pocket is normally covered by the hair on the top of the body. The pocket includes a sack portion and a cover flap for the sack portion, the cover flap being swingable to cover and uncover the sack portion whereby items, such as for instance notes, can be placed in the pocket to entrust the contents of the pocket to the doll. It is contemplated that a user of the doll, such as a child, would also be able to "talk to" the doll by communicating with the ear/-pocket or by delivering written material, such as notes, to the doll by placing such material within the pocket of the receptacle.

3 Claims, 3 Drawing Figures

DOLL HAVING CONCEALED POCKET IN THE LOCATION OF AN EAR

FIELD OF THE INVENTION

This invention relates to a doll particularly developed for the entertainment of children or possibly others, which doll has a receptacle formed as a part thereof, which receptacle can receive written communications from the user of the doll whereby to entrust such communications to the custody and care of the doll.

BACKGROUND OF THE INVENTION

The invention derives from the well known need of children to communicate with others and to provide, as the object of such communication, a doll which can be trusted by the child to receive the communications of the normally young user of the doll and to retain in a safe place and position, such communications. Thus, there has been a need for a doll which is cuddly in nature and which can be held by a child, the doll having a receptacle which simulates an ear into which the child may talk when holding the doll. Yet further if the child desires to entrust a written message to the doll or, for that matter, other objects, the receptacle is in the form of a simulated ear but is provided with a pocket portion and a cover flap whereby the cover flap may be raised and the written communication or other object entrusted to the custody and care of the doll by placing it in the pocket, closing the pocket with the cover flap and then covering the simulated ear and receptacle with the hair of the doll.

SUMMARY OF THE INVENTION

The invention provides a doll having a receptacle as a part thereof, the receptacle being in the form of a pocket carried by the body of the doll which pocket is accessible to the user of the doll. The doll shown is polyhedral in configuration and is provided with a front, a back, a top, a bottom and opposed sides, there being a face on the front of the doll and hair on the top of the doll, the hair covering the pocket which simulates an ear of the doll. The pocket includes a sack portion and a cover flap whereby a user of the doll may place an object, such as for instance a written communication, in the sack portion of the receptacle to thereby entrust the communication to the care and custody of the doll, this providing a child with an opportunity to communicate with its doll.

DESCRIPTION OF THE PREFERRED EMBODIMENT

Figure 1:
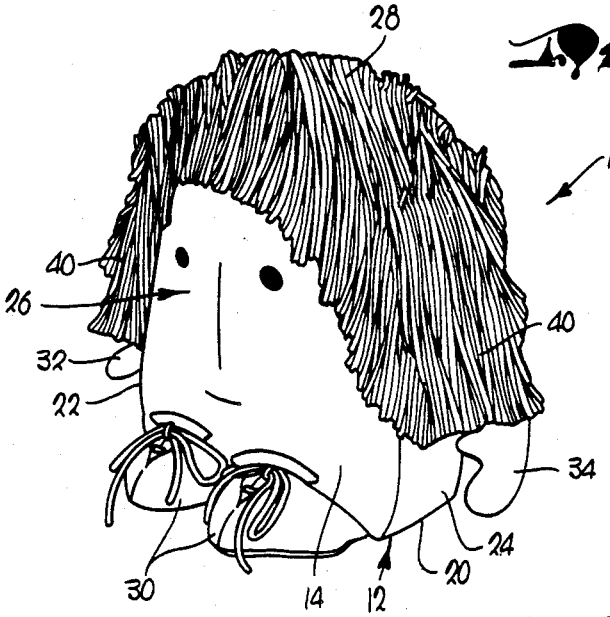
FIG. 1 is a front perspective view showing the doll having a receptacle formed as a part thereof.

The doll 10 hereinafter described is preferably made of a fabric material with a suitable fabric or plastic stuffing, whereby to present a body 12 which is generally polygonal in configuration whereby to present a front

14, a back 16, a top 18, a bottom 20 and a pair of opposed sides 22 and 24.

It will be appreciated that the doll 10 may be of any suitable configuration and could have extended arms or legs, as contrasted to the configuration illustrated.

The front 14 of the doll 10 is provided with a suitable face 26 which, again, may be of any desired appearance, depending upon the aesthetic appearance to be imparted to the doll 10.

The top 18 of the doll 10 may be provided with simulated hair 28 which may be fabricated from a fabric material or a plastic material and which is intended to extend downwardly from the top 18 over a major portion of the respective sides 22 and 24.

The bottom 20 of the doll 10 is provided with a pair of feet 30 which, as noted, could be at the end of extended legs or may be truncated as illustrated in the embodiment shown.

The sides 22 and 24 of the doll body 12 are each provided with simulated arms 32 and 34 which, again, may be extended in nature or may be essentially truncated as shown on the embodiment chosen for illustration.

The receptacle 36 is carried by the doll body 12 on one or both of the sides 22, 24 thereof, the embodiment chosen for illustration having the receptacle 36 on the side 22.

Receptacle 36 is in the form of a pocket 38 which pocket is attached to the side 22 of the doll body 12 as by sewing, adhesive or the like, whereby the pocket 38 of receptacle 36 is securely attached to the doll body.

It is to be noted that the receptacle 36 is positioned toward the uppermost end of the side 22 of the doll body 12 whereby to simulate an ear of the doll 10, the simulated ear in the form of the receptacle 36 being covered by the long ends 40 of the hair 28 when the hair is in its normal position as shown for instance in FIG. 1 of the drawing.

Figure 2:
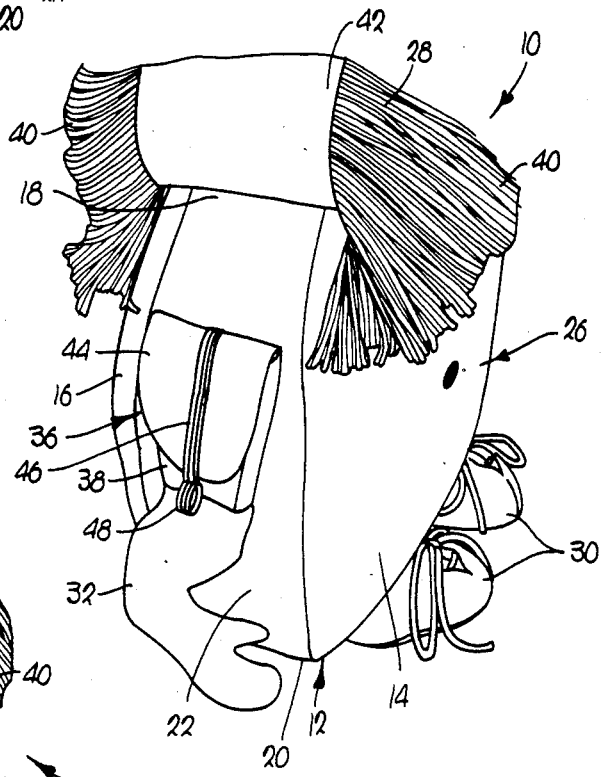
FIG. 2 is a side perspective view of the doll with the hair of the doll being raised to show the receptacle, the receptacle being in a closed condition.
Figure 3:
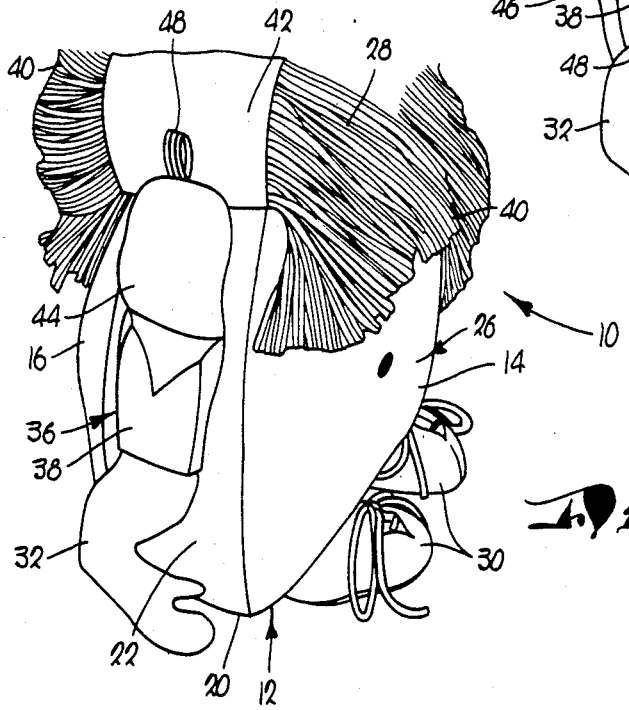
FIG. 3 is a view similar to FIG. 2 but with the cover flap of the receptacle pocket being raised to an open condition.

However, when it is desired to gain access to the receptacle 36, which simulates an ear of the doll 10, the end portions 40 of the hair 28, which are secured to a suitable stretch of material such as 42, shown in FIGS. 2 and 3, which is attached to top 18 of body 12 and which may be raised by grasping the hair 40 at its lowermost end and swinging the hair 40 and stretch 42 upwardly. Once this has been accomplished, access is initially gained to the receptacle 36.

The receptacle 36, in addition to having the sack portion 38, is provided with a cover flap 44 which is secured, at the top thereof, to the side 22 of the doll 10 or to sack 38 whereby the cover flap 44 may be swung upwardly to permit access to the interior of the pocket 38 of the receptacle 36.

To permit such swinging movement of the flap 44, there is provided a handle extension member 46 which is secured to the flap 44 at the center thereof and is suitably attached thereto whereby to present a depending loop 48 which may be grasped by the user of the doll to thereby raise the flap 44 and gain access to the interior of the pocket 38 of the receptacle 36.

It will be appreciated that a receptacle such as 36 may be positioned on either side of the doll body 12 so that the user thereof may have access to one or two ear simulating receptacles such as 36. In the embodiment as illustrated, only one of such receptacles is shown but the other receptacle, which would be on the side 24 of the doll 10, would be identical in configuration and utilization.

The object of providing the receptacle 36 is to permit the user of the doll, normally a child, to in effect communicate with the doll as by placing a written communication from the child to the doll in the receptacle 36 by raising the flap 44 and inserting the communication within the sack 38, then closing the flap 44 and lowering the hair 40 of the doll whereby the communication is safely and securely entrusted to the care and custody of the doll.

It will also be appreciated that, since the receptacle 36 is in a position to simulate an ear of the doll, the child, user of the doll, might well communicate with the doll by whispering or talking to the ear/receptacle 36 whereby the doll would be orally entrusted with the secrets of the child. Thus, the doll becomes a confidante of the child in that the child has entrusted to the doll the secrets or confidences of the child, either orally or in written form and the doll becomes the trustee therefor.

What is claimed is:

1. A doll having a polyhedral, stuffed body, the body having a front, a back, a top, a bottom and opposite sides and including:

a simulation of a face formed on said front, a pocket on the doll accessible from the exterior surface of the body and situated, in relation to said face, in the position of an ear of the doll having said face, the pocket representing the ear of the doll, said pocket including means providing ready access to the interior of said pocket for the placement of objects therein, said doll having means complementing the face and normally concealing the pocket.

2. A doll as set forth in claim 1, said means providing access to the pocket including a closure flap for the pocket operable by the user of the doll to gain access to the interior of the pocket and therefore the ear of the doll.

3. A doll as set forth in claim 2, there being flexible hair on the body, the hair normally concealing the pocket.

* * * * *